United States Patent [19]

Yamano et al.

[11] 4,105,913

[45] Aug. 8, 1978

[54] CORE MAGNETRON AND METHOD OF MANUFACTURING PERMANENT MAGNETS THEREFOR WITH LOW GAS EMISSION

[75] Inventors: Masaru Yamano, Hirakata; Toshio Iemura, Kyoto, both of Japan

[73] Assignee: Sanyo Electric Co., Ltd., Moriguchi, Japan

[21] Appl. No.: 707,010

[22] Filed: Jul. 20, 1976

[30] Foreign Application Priority Data

Aug. 11, 1975 [JP] Japan ..... 50-111250

[51] Int. Cl.[2] ..... H01J 25/50

[52] U.S. Cl. ..... 315/39.71; 315/39.51; 315/39.75; 148/120; 148/121

[58] Field of Search ..... 315/39.71, 39.75, 39.51; 148/120, 121, 148

[56] References Cited

U.S. PATENT DOCUMENTS

| | | | |
|---|---|---|---|
| 2,446,826 | 8/1948 | McArthur | 315/39.71 X |
| 2,468,576 | 4/1949 | Teare | 315/39.71 |
| 3,376,466 | 4/1968 | Gerard | 315/39.75 |
| 3,867,211 | 2/1975 | Easton | 148/121 |
| 3,868,278 | 2/1975 | Foster et al. | 148/120 |
| 3,954,519 | 3/1976 | Inoue | 148/121 |
| 3,977,919 | 8/1976 | Foster et al. | 148/120 |
| 3,982,972 | 9/1976 | Iwata et al. | 148/121 |
| 3,989,556 | 11/1976 | Iwata et al. | 148/121 |

*Primary Examiner*—Saxfield Chatmon, Jr.
*Attorney, Agent, or Firm*—Staas & Halsey

[57] ABSTRACT

A core type magnetron comprising a vacuum envelope which includes an open ended magnetic anode cylindrical member and magnetic upper and lower end plates for closing the opposite end openings of the cylindrical member. Internal to the vacuum envelope, a plurality of anode vanes are provided which extend in a radial direction from the approximate middle of the inner wall of the cylindrical member toward the center of the envelope. A pair of permanent magnets provided internal to the envelope, each extending from opposite end plates toward the anode vanes. By this arrangement, an operating space is defined by the opposing surfaces of the pair of the magnets and the anode vanes, such that a magnetic flux is applied to said operating space. A cathode is provided within the operating space. The magnets employed are characterized as being low in the emission of gases during operation of the magnetron, since they are manufactured by a process which includes melting designated source materials mixed with a small amount of silicon in a vacuum, casting the melt in a vacuum, followed by forging.

17 Claims, 2 Drawing Figures

CORE MAGNETRON AND METHOD OF MANUFACTURING PERMANENT MAGNETS THEREFOR WITH LOW GAS EMISSION

BACKGROUND OF THE INVENTION

1. Field of the Invention

The present invention relates to a core type magnetron, and more specifically relates to such a magnetron wherein the permanent magnet of which has been improved.

2. Description of the Prior Art

A core type magnetron typically comprises a permanent magnet built inside a vacuum envelope which also encloses a cathode and anode vanes such that a magnetic field is applied to an operating space surrounding the cathode. Typically the core type magnetron has various advantages, as compared with a shell type magnetron wherein a permanent magnet is provided outside the vacuum envelope, since in the core type magnetron, the magnetic circuit is shorter, the permanent magnet is small in size and the vacuum envelope is formed of a magnetic material such as iron. Therefore, the vacuum envelope per se is used as a magnetic path.

In general, electronic tubes, including core type magnetrons, suffer from deterioration of performance, partly because of emission of undesired gasses from the structure of such electronic tubes. Particularly in magnetrons, emitted undesired gasses such as oxygen within the vacuum envelope degrade the surface condition of the cathode to decrease the rate of emission of electrons from the cathode and thereby cause the performance to be adversely affected.

Heretofore it has been proposed that proper countermeasures be taken to the structure components such as a cathode, anode vanes and the like during the manufacture of the magnetrons. However, in case of a core type magnetron, no countermeasure has been proposed for suppressing emission of undesired gasses from the permanent magnet located inside the vacuum envelope of the magnetron. In view of the fact that in a core type magnetron the permanent magnet occupies a comparatively large volume of the vacuum envelope and in addition the permanent magnet is heated to a high temperature during operation of the magnetron, the emission of gasses from the outer surface of the permanent magnet is a serious problem.

For the purpose of preventing emission of undesired gasses from the outer surface of the permanent magnet within the vacuum envelope, one might simply think of enclosing the permanent magnet with a given material such as a copper plate. However, this approach makes the structure of the magnetron complicated to manufacture and also requires the size of the vacuum envelope to be larger.

SUMMARY OF THE INVENTION

Briefly stated, the present invention is directed to an improved core type magnetron comprising a low gas emission permanent magnet in a vacuum envelope, which encloses a cathode, and anode vanes surrounding the cathode such that a magnetic field is applied to an operating space defined around the cathode. The improvement is characterized in that the low gas emission permanent magnet is manufactured by a process including the steps of melting and casting the source materials in a vacuum and thereafter forging the same.

Therefore, it is a principal object of the present invention to provide an improved core type magnetron, wherein deterioration of the performance during the lapse of time has been minimized.

It is another object of the present invention to provide an improved core type magnetron, wherein emission of undesired gasses from the outer surface of the permanent magnet is eliminated while retaining a simplified structure.

These objects and other objects, features, aspects and advantages of the present invention will be better understood from the following detailed description of the present invention when taken in conjunction with the accompanying drawings.

DESCRIPTION OF THE PREFERRED EMBODIMENTS

In order to achieve the objects of the present invention, the magnetron disclosed herein is characterized in that it comprises a low gas emission permanent magnet within a vacuum envelope. The permanent magnet utilized in this magnetron is manufactured in a process including the steps of melting and casting the source materials in a vacuum and thereafter forging the same. It has been empirically observed that the permanent magnet manufactured by the abovementioned steps emits a considerably lesser amount of gasses, even when heated in a vacuum to a relatively high temperature as during normal operations of a core type magnetron. The amount of gas emitted is determined to be small in comparison with a conventional type cast magnet manufacturing process which is carried out in standard atmospheric conditions, such as an alnico type magnet. The amount of emitted gasses from the surface of the permanent magnet of the present invention built in a core type magnetron when in an actual operating condition is as little as half that of a conventional permanent magnet in a conventional core type magnetron.

Figure 1:
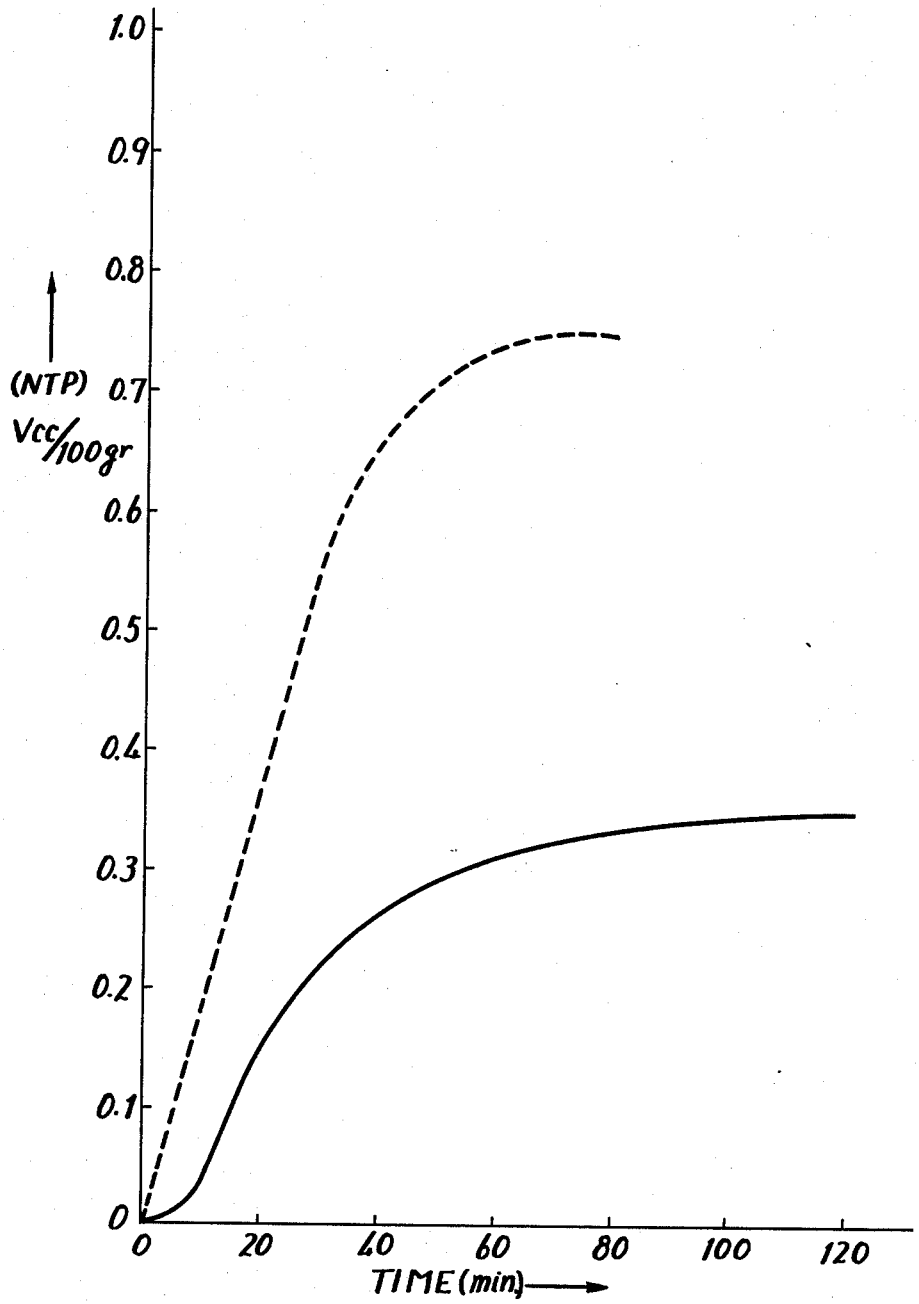
FIG. 1 is a graph showing a characteristic of emission of gasses from the surface of a permanent magnet for use in the present invention.

FIG. 1 is a graph showing a characteristic of emission of gasses from a permanent magnet of the present invention, in comparison with the characteristic of emission of a conventional permanent magnet. The solid and dotted lines indicate the characteristic of gas emission of the magnet, suitable for use in this invention and a conventional cast magnet, respectively. In FIG. 1, the abscissa indicates the lapse of time and the ordinate indicates the amount of emitted gasses in terms of per 100g at normal operating temperature and pressure. The normal measurement condition being that the degree of vacuum is smaller than $10^{-5}$Torr and temperature of the magnets is 450° C.

Figure 2:
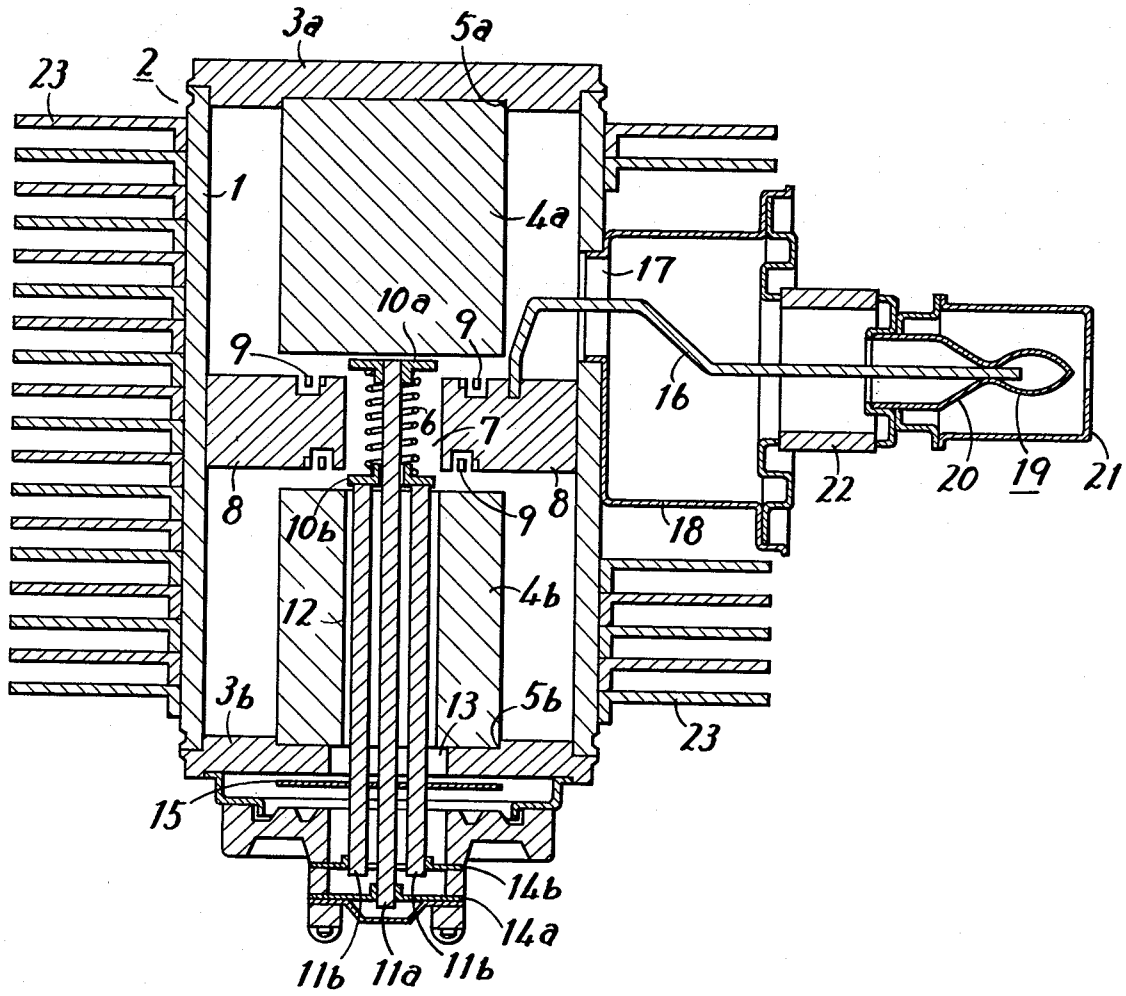
FIG. 2 is a sectional view of an embodiment employing the present invention.

FIG. 2 is a sectional view of an embodiment of the present invention. Referring to FIG. 2, the magnetron embodiment shown basically comprises an anode cylindrical member 1 and a pair of magnetic plates **3*a* and 3*b* for enclosing the opposite end openings of the anode cylindrical member 1. The anode cylindrical member 1 is made of a magnetic material, such as iron, forms the enclosing side wall of a vacuum envelope 2 and also constitutes a portion of the magnetic circuit of the magnetron. The plates 3*a* and 3*b* are also made of a magnetic material, such as iron, form upper and lower covers of the vacuum envelope 2 and also constitute a portion of the magnetic circuit, together with the anode cylindrical member 1. The inner surfaces of the anode cylindrical member 1 and the magnetic plates 3***a* and 3*b* (the inner surfaces of the vacuum envelope 2) are plated with nickel.

A pair of permanent magnets 4*a* and 4*b* are fixed to recesses 5*a* and 5*b* of the magnetic plates 3*a* and 3*b*, respectively, by spot welding at three points on the periphery of the magnets, for example. The permanent magnets 4*a* and 4*b* are located within the vacuum envelope 2 for the purpose of applying a magnetic flux to the operating space 7 around a cathode 6, which is described below.

The permanent magnets 4*a* and 4*b* are formed in accordance with the features of the present invention by the steps of melting and casting the source materials in a vacuum and thereafter forging the same. A process for manufacturing the said magnet are now described in more detail.

In the first step, the source materials, i.e. highly purified iron, chromium and cobalt, admixed with a small amount of silicon for the purpose of removing oxygen, are melted in a high frequency induction furnace. The said melting step is carried out at a temperature of about 1600° C and under the degree of vacuum of $10^{-1}$Torr. The parts of iron, chromium, cobalt and silicon are 53.85%, 27.55%, 17.53% and 1.07%, respectively. In the second step where the above described vacuum of $10^{-3}$Torr is maintained, the melted mixture of source materials are cast in a predetermined cast mold under approximately the same degree of vacuum, whereby an ingot is formed. Then, the ingot is naturally cooled off and an argon atomosphere is substituted for the vacuum. Thereafter the ingot is taken out of the furnace and is hot forged in the atomosphere (air) at a temperature of 1250° C and thereafter is subjected to the well known steps, i.e. solution heat treatment, processing under magnetic field, rolling, magnetic heat treatment and the like, whereupon the product is completed.

Between the pair of magnets 4*a* and 4*b*, a plurality of anode vanes 8, 8, 8 . . ., made of highly conductive material such as copper are fixed directly to the inner wall of the anode cylindrical member 1 by means of silver solder. The anode vanes 8, 8, 8 . . . extend radially toward the center of the cylindrical member 1. Strap rings 9 are provided so as to short circuit alternate anode vanes 8 together so that alternate anode vanes are at the same potential for the purpose of stabilizing the oscillation frequency of the magnetron. Preferably, the portion of the inner wall of the anode cylindrical member 1 between the anode vanes 8, 8, 8 . . . is coated with a thin film of highly conductive material to form cavity resonators defined by adjacent anode vanes 8, 8, 8 . . . and the inner wall surface of the anode cylindrical member 1 where the thin film is formed. The thin film is preferably formed on the inner wall of the anode cylindrical member, by either a silver soldering, copper plating or silver plating method to a thickness exceeding skin depth.

A direct heat type, coil shaped cathode 6, of thoriated tungsten (ThW) for example, is provided in the center of the operating space 7, defined by the permanent magnets 4*a* and 4*b* and anode vanes 8, 8, 8 . . . . A pair of end shields 10*a* and 10*b* are provided such that they support the cathode 6 at both ends and provide electrical connection to the cathode 6. A conductive cathode support 11*a* is provided so as to extend along an axis through apertures 12 and 13 in the permanent magnet 4*b* and the lower cover magnetic plate 3*b*, respectively. The support 11*a* is connected to the end shield 10*a* at one end and is connected to a power source terminal plate 14*a* at the other end. Another conductive cathode support 11*b* is similarly provided so as to surround the supporter 11*a* and to extend through the apertures 12 and 13, such that it is connected to the end shield 10*b* at one end and is connected to another power source terminal plate 14*b* at the other end. As a result, when a voltage is applied between the voltage source terminal plates 14*a* and 14*b*, the direct heat type, coil shaped cathode 6 is supplied with a current through the conductive supports 11*a* and 11*b* and the end shields 10*a* and 10*b*, so that the cathode is directly heated according to the Joule's law principle.

An electrically conductive disk type choke plate 15 is provided outside of the lower cover magnetic plate 3*b* having the aperture 13 and close to the magnetic plate 3*b* such that it is fixed to the support 11*a* while it is separated from the support 11*b*. A large electrostatic capacitance is formed between the choke plate 15 and the magnetic plate 3*b* so as to short circuit the generated microwave and thus to prevent leakage thereof to the power supply.

An antenna 16 is provided so as to have one end coupled to one of the anode vanes 8 and to have another end protrude through an aperture 17 formed in the side wall of the anode cylindrical member 1. An antenna cavity 18 is provided that is electrically connected to the anode cylindrical member 1 so as to enclose a portion of the antenna 16 protruding through the anode cylindrical member 1. The exemplifying embodiment also shows a seal portion 19 for sealing the chip end of the antenna 16 within a conductive tubulation 20 after exhausting the internal gass, a protective cap 21 for the sealing portion, an insulation 22 for insulating sealing portion 19 and the antenna cavity 18, and radiating fins 23 directly fixed to the outer wall of the anode cylindrical member 1 by means of screws, welding or the like.

In such a core type magnetron as described in the foregoing, the permanent magnets 4*a* and 4*b* occupy a considerable volume within the vacuum envelope 2 and the temperature of the magnetron rises to a considerably high temperature during the operation. However, according to the present invention, little gas is emitted from the permanent magnets 4*a* and 4*b* during the operation of the magnetron, as described with reference to FIG. 1. Therefore, deterioration of performance of the magnetron during the lapse of time is at a much slower rate.

The present invention has made skillful use of a novel and advantageous discovery that a permanent magnet manufactured in a vacuum shows an excellent characteristic of low gas emission when it is employed in a core type magnetron. Hence, the present invention illustrates that the emission of undesired gasses from the permanent magnet within the vacuum envelope can be suppressed by utilizing a simple structure and without necessity of adopting such a complicated structure that further encloses the permanent magnet within the vacuum envelope. Thus, the present invention is greatly contributory to an improvement in the rate of deterioration of the operating characteristic of a core type magnetron.

What is claimed is:

1. A core type magnetron comprising a vacuum envelope including a cathode, anode vanes surrounding said cathode and a permanent magnet for applying a magnetic field in the vicinity of said cathode, wherein said permanent magnet has been manufactured by a process to substantially reduce the emission of gases from said permanent magnet when the magnetron is operating including; the steps of melting source materials as required for a hard magnet having high retentivity in a vacuum at an elevated temperature of more than 1300° C, casting the melt in a vacuum, and thereafter hot forging the same at another elevated temperature before finishing with conventional known steps.

2. A core type magnetron as in claim 1, wherein said melting steps in a vacuum at an elevated temperature is at a temperature of approximately 1600° C.

3. A core type magnetron as in claim 1, together with a cooling step in a non-oxidizing atmosphere following the casting step.

4. In a core type magnetron comprising a vacuum envelope including a magnetic anode cylindrical member, magnetic upper and lower end plates for closing opposite end openings of said cylindrical member, a plurality of anode vanes provided at the inner wall in the middle of said cylindrical member so as to extend in a radial direction toward the center of said cylinder member, a pair of permanent magnets provided on the opposite end plates so as to extend toward the anode vanes, whereby an operating space is defined by opposing end surfaces of the pair of magnets and the anode vanes such that a magnetic flux is applied to said operating space, and a cathode provided within said operating space, an imrpovement wherein said pair of magnets are manufactured by means to substantially reduce the emission of gases from said permanent magnets when the magnetron is operating including; the steps of melting source materials consisting of substantial amounts of purified iron, chromium and cobalt admixed with a small amount of silicon in a vacuum at an elevated temperature, casting the melt in a vacuum and then hot forging the same at another elevated temperature before finishing with conventional known steps.

5. A core type magnetron as in claim 4, wherein said melting step in a vacuum at an elevated temperature is at a temperature of more than 1300° C.

6. A core type magnetron comprising:

a vacuum envelope defined by an anode cylinder member, having opposite end openings, and plate members covering said opposite end openings;

anode vanes mounted on said cylindrical member internal to said envelope and extending radially toward the center of said cylindrical member;

a cathode member supported at the center of said cylindrical member spaced from said anode vanes; and a plurality of permanent magnets attached to said plate members internal to said envelope and extending toward said cathode member to provide a magnetic field between said cathode and said anode vanes;

said permanent magnets are formed by means to substantially reduce the emission of gases from said permanent magnet when the magnetron is operating including mixing predetermined amounts of source materials consisting essentially of purified iron, chromium and cobalt with a predetermined amount of silicon;

providing a vacuum;

melting said mixed source materials in said vacuum at a temperature of more than 1300° C;

casting said melted mixture in said vacuum to form an ingot;

cooling said ingot in an inert atmosphere; and thereafter, forging said ingot.

7. A core type magnetron as in claim 6, where in said source materials are mixed in the following amounts:

purified iron, approximately 53.85%;

chromium, approximately 27.55%;

cobalt, approximately 17.53%; and silicon, approximately 1.07%.

8. A core type magnetron as in claim 6, wherein said vacuum is provided and maintained at approximately $10^{-3}$ Torr.

9. A core type magnetron as in claim 6, wherein said step of cooling is carried out in an atmosphere of argon gas.

10. A core type magnetron as in claim 9, wherein said step of forging is carried out in air at an elevated temperature melting at an elevated temperature and casting the source materials of said permanent magnet in a vacuum, and hot forging said cast source materials for forming said permanent magnet at another elevated temperature.

11. A method of producing a magnetron having a permanent magnet with low gas emission characteristics, including the steps of:

mixing predetermined amounts of source materials consisting essentially of purified iron, chormium and at least 14% cobalt with a predetermined amount of silicon;

providing a vacuum;

melting said mixed source materials in said vacuum at more than 1300° C;

casting said melted mixture in said vacuum to form an ingot;

cooling said ingot in an inert atmosphere; and thereafter, forging said ingot;

and then finishing said permanent magnet by the conventional steps of solution heat treatment, processing under a magnetic field, rolling, magnetic heat treatment and the like, whereupon the magnet is completed;

and then assembling said permanent magnet into said magnetron.

12. A method of producing a permanent magnet as in claim 11, wherein said source materials are mixed in the following amounts:

purified iron, approximately 53.85%;

chromium, approximately 27.55%;

cobalt, approximately 17.53%; and silicon, approximately 1.07%.

13. A method of producing a permanent magnet as in claim 11, wherein said vacuum is provided at approximately $10^{-3}$ Torr.

14. A method of producing a permanent magnet as in claim 11, wherein said melting step is carried out at a temperature of approximately 1600° C.

15. A method of producing a permanent magnet as in claim 11, wherein said step of cooling is carried out in an atmosphere of argon gas.

16. A method of producing a permanent magnet as in claim 11, wherein said step of forging is carried out in air at about 1250° C.

17. A core type magnetron comprising a vacuum envelope including a cathode, anode vanes surrounding said cathode and a permanent magnet for applying a magnetic field in the vicinity of said cathode, wherein said permanent magnet has been manufactured by means to substantially reduce the emission of gases from said permanent magnet when the magnetron is operating including; the steps of melting source materials consisting of substantial amounts of purified iron, chromium and cobalt admixed with a small amount of silicon in a vacuum at an elevated temperature, casting and cooling the melt in a non-oxidizing atmosphere and thereafter hot forging the same at another elevated temperature before finishing with conventional known steps.

* * * * *

UNITED STATES PATENT AND TRADEMARK OFFICE

CERTIFICATE OF CORRECTION

PATENT NO. : 4,105,913

DATED : August 8, 1978

INVENTOR(S) : MASARU YAMANO ET AL.

It is certified that error appears in the above-identified patent and that said Letters Patent are hereby corrected as shown below:

Col. 3, line 27, "$10^{-1}$" should be --$10^{-3}$--;

Col. 3, line 37, "atomosphere" should be --atmosphere--;

Col. 4, line 38, "gass" should be --gas--;

Col. 4, line 39, "insulation" should be --insulator--;

Col. 5, line 6, "gases" should be --gasses--;

Col. 5, line 35, "gases" should be --gasses--;

Col. 5, line 62, "gases" should be --gasses--;

Col. 6, line 7, "where in" should be --wherein--;

Col. 6, line 32, "chormium" should be --chromium--;

Col. 7, line 6, "gases" should be --gasses--.

Signed and Sealed this

*Thirteenth* Day of *March 1979*

[SEAL]

*Attest:*

RUTH C. MASON
*Attesting Officer*

DONALD W. BANNER
*Commissioner of Patents and Trademarks*